US009885540B2

(12) United States Patent
Bennett

(10) Patent No.: US 9,885,540 B2
(45) Date of Patent: Feb. 6, 2018

(54) SLING WITH ADJUSTABLE AND TENSIONABLE ENDS AND METHODS AND APPARATUS FOR MAKING AND USING THE SAME

(71) Applicant: Brenton Bennett, Valley, AL (US)

(72) Inventor: Brenton Bennett, Valley, AL (US)

( * ) Notice: Subject to any disclaimer, the term of this patent is extended or adjusted under 35 U.S.C. 154(b) by 55 days.

(21) Appl. No.: 15/009,060

(22) Filed: Jan. 28, 2016

(65) Prior Publication Data

US 2016/0223289 A1 Aug. 4, 2016

Related U.S. Application Data

(60) Provisional application No. 62/109,774, filed on Jan. 30, 2015.

(51) Int. Cl.

| | |
|---|---|
| ***F41C 33/00*** | (2006.01) |
| ***A45F 5/10*** | (2006.01) |
| *A45F 5/00* | (2006.01) |

(52) U.S. Cl.

CPC ..... *F41C 33/002* (2013.01); *A45F 5/10* (2013.01); *A45F 2005/006* (2013.01); *A45F 2005/1013* (2013.01); *A45F 2200/0591* (2013.01)

(58) Field of Classification Search

CPC .... F41C 33/002; A45F 5/10; A45F 2005/006; A45F 2005/1013; A45F 2200/0591

USPC ..... 224/150

See application file for complete search history.

(56) References Cited

U.S. PATENT DOCUMENTS

| | | | | |
|---|---|---|---|---|
| 1,383,125 A * | 6/1921 | Kennedy, Jr. | F41C 33/001 | 224/150 |
| 2,830,747 A * | 4/1958 | Creste | F41C 23/02 | 224/150 |
| 3,495,770 A * | 2/1970 | Jack | F41C 33/002 | 224/150 |
| 3,595,451 A * | 7/1971 | Branby | F41C 33/002 | 224/150 |
| 4,098,441 A * | 7/1978 | Campbell | F41C 23/02 | 224/150 |
| 4,249,686 A * | 2/1981 | Morwood | F41C 33/001 | 224/150 |
| 4,299,343 A * | 11/1981 | Atchisson | F41C 23/02 | 224/149 |

(Continued)

OTHER PUBLICATIONS

LRRP Sling 2 Point King Cobra Braid Loop Tie Rifle Sling; www.eBay.com; 2 pgs; date unknown.

(Continued)

*Primary Examiner* — Peter Helvey
(74) *Attorney, Agent, or Firm* — Gardner Groff Greenwald & Villanueva, PC

(57) ABSTRACT

A sling having tensionable ends such that the sling can be provided for carrying, strapping, tethering, handling or otherwise engaging one or more objects, for example, a firearm, collapsible chair, bow, an animal, etc. In one example form, the sling includes a woven portion extending from a first end to a second end and defining a length therebetween. The woven portion includes a plurality of woven segments extending along the length. The first and second ends have tensionable loops extending therefrom, and at least one of a plurality of woven portions is moved towards or away from at least one of the first or second ends to cause adjustment to the size of the loops.

18 Claims, 9 Drawing Sheets

(56) References Cited

U.S. PATENT DOCUMENTS 4,311,263 A * 1/1982 Bianchi ..... A45C 13/30 224/150
4,361,258 A * 11/1982 Clark ..... F41C 33/002 224/150
4,401,246 A * 8/1983 Dickinson ..... F41C 33/002 224/150
4,555,051 A * 11/1985 Johnson ..... F41C 23/02 224/149
4,658,999 A * 4/1987 Hilty ..... A45F 3/14 224/150
4,823,998 A * 4/1989 Johnson ..... F41C 23/02 224/150
5,009,346 A * 4/1991 Butler ..... A45C 11/00 206/229
5,246,154 A * 9/1993 Adams ..... A45F 3/14 224/150
5,353,538 A * 10/1994 Hakedal ..... F41C 23/02 224/150
5,433,360 A * 7/1995 Rock ..... A44B 11/25 224/150
5,501,025 A * 3/1996 Johnson ..... F41C 23/02 224/150
5,615,811 A * 4/1997 Bell ..... F41C 23/02 224/150
5,642,847 A * 7/1997 DeMeo ..... A45F 5/00 224/149
5,655,803 A * 8/1997 Tacoronte ..... F41C 33/00 224/150
5,915,939 A * 6/1999 French ..... F41C 23/02 224/150
6,019,404 A * 2/2000 Pasquale ..... F41A 17/44 224/150
6,068,167 A * 5/2000 Hopson ..... A45C 13/30 224/150
6,279,795 B1 * 8/2001 Pierzina ..... A45F 3/12 224/150
7,069,624 B2 * 7/2006 Johnson ..... F41C 23/02 224/150
7,841,496 B1 * 11/2010 Schweikert ..... F41C 33/002 224/150
7,930,851 B1 * 4/2011 Woolsey ..... F41C 23/02 224/150
7,988,023 B1 * 8/2011 Nykoluk ..... F41C 33/002 224/150
8,056,778 B1 * 11/2011 Michaux ..... F41C 33/001 224/149
8,429,798 B1 * 4/2013 Paigen ..... A44B 11/22 224/150
2002/0153394 A1 * 10/2002 Borson ..... F41C 33/001 224/150
2004/0182894 A1 * 9/2004 Johnson ..... F41C 33/002 224/150
2004/0188476 A1 * 9/2004 Johnson ..... F41C 33/002 224/150
2006/0011677 A1 * 1/2006 Burnsed, Jr. ..... F41C 33/001 224/150
2007/0094911 A1 * 5/2007 Rush ..... F16M 11/16 42/85
2007/0257072 A1 * 11/2007 Pena ..... F41C 23/02 224/150
2008/0217371 A1 * 9/2008 Wemmer ..... F41C 23/02 224/579
2009/0126083 A1 * 5/2009 Holtzclaw, Jr. ..... A41F 9/002 2/300
2010/0206921 A1 * 8/2010 Shen ..... F41C 33/002 224/150
2011/0062194 A1 * 3/2011 Esch ..... F41C 33/002 224/150
2011/0186603 A1 * 8/2011 Alford ..... F41C 33/00 224/150
2012/0043357 A1 * 2/2012 Campbell ..... A01M 31/006 224/103
2012/0168470 A1 * 7/2012 Burton ..... F41C 23/02 224/150
2012/0193378 A1 * 8/2012 Schroedel, Jr. ..... F41C 23/02 224/150
2012/0255976 A1 * 10/2012 Dees ..... F41C 33/001 224/150
2012/0280006 A1 * 11/2012 Garrett ..... F41C 33/002 224/150
2014/0203053 A1 * 7/2014 Rivas-Schlanger ... F41C 33/002 224/150
2014/0263489 A1 * 9/2014 Hendricks ..... F41C 33/002 224/150
2014/0346199 A1 * 11/2014 Golob ..... F41C 33/002 224/150
2015/0076181 A1 * 3/2015 Seuk ..... F41C 33/002 224/150
2015/0168097 A1 * 6/2015 Echevarria ..... F41C 33/002 224/150
2015/0198411 A1 * 7/2015 Chudzik ..... F41C 33/002 224/150
2016/0084613 A1 * 3/2016 Biggs ..... F41C 33/002 224/150
2016/0169618 A1 * 6/2016 Kunkel ..... F41C 33/002 224/150

OTHER PUBLICATIONS

Paracord Rifle Gun Sling with Adjustable Strap and Quick Swivels; www.eBay.com; 1 pg; date unknown.
Paracord Rifle/Shotgun Sling with Metal Swivels; www.eBay.com; 1 pg; date unknown.

* cited by examiner

SLING WITH ADJUSTABLE AND TENSIONABLE ENDS AND METHODS AND APPARATUS FOR MAKING AND USING THE SAME

CROSS-REFERENCE TO RELATED APPLICATION

This application claims the benefit of U.S. Provisional Patent Application Ser. No. 62/109,774, filed Jan. 30, 2015, the entirety of which is hereby incorporated herein by reference.

TECHNICAL FIELD

The present invention relates generally to the field of straps, slings, or other carrying handles, and more particularly to a strap or sling having ends that can be adjustably tensioned.

BACKGROUND

Commonly, luggage, bags, briefcases, tools, firearms, etc. can be provided with a strap or sling for easing the burden of carrying the object, for example, where the strap or sling is either placed on a user's shoulder, thereby freeing up their hands for other tasks, or where the strap is intended to be grasped by one or more hands.

With particular reference to rifle slings, for example, slings commonly utilize hardware clips or other connectors where portions of the ends of the sling removably attach to hardware mounting pins of the rifle, for example, the end portions of the stock (e.g., one pin positioned generally near the butt of the stock and one pin positioned generally adjacent the stock portion near the barrel). Generally, known mounting pins are either threaded to the stock or otherwise permanently attached thereto. This often includes drilling into the firearm to receive screw threads of the mounting hardware, and/or mounting metal hardware to the firearm and potentially scratching or marring the finish of the firearm. Unfortunately, with more expensive and delicate firearms such as over-and-under shotguns or antique firearms, it is generally desired to preserve the finish of the firearm, and therefor mounting pins are generally not considered or desired.

Continuing needs exist for improvements to straps or slings for use with firearms and/or other equipment, tools, gear, etc. that may be desirable to carry, strap or couple together. It is to the provision of an improved strap or sling that the present invention is primarily directed.

SUMMARY

In example embodiments, the present invention provides a sling having adjustably tensionable ends for removably engaging objects, for example, a firearm barrel or a portion of the sling itself. In one aspect, the present invention relates to a sling having a generally centrally positioned woven portion extending from a first end to a second end and defining a length therebetween. The woven portion includes a plurality of woven segments extending along the length. The first and second ends have tensionable loops extending therefrom. Preferably, at least one of a plurality of woven portions is movable towards one of the first or second ends to cause adjustment to the size of the loops.

In another aspect, the invention relates to strap including a main line and a centrally positioned woven portion having a plurality of similarly patterned weaves, the weaves generally being woven at least partially around the main line, wherein at least a portion of the main line extends from each end of the woven portion to form loops, and wherein the weaves can be moved along the main line such that the size of the loop at each end can be adjusted.

In another aspect, the invention relates to a tensionable and universal strap including a generally elongate and flexible member having a first end and a second end generally opposite thereto, a central woven portion having a series of inter-linked weave segments defining a continuous woven pattern, a first tensionable loop defined between the first end and a portion of the central woven portion, and a second tensionable loop defined between the second end and a portion of the central woven portion.

These and other aspects, features and advantages of example embodiments of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of example embodiments of the invention, and are not restrictive of the invention, as claimed.

DETAILED DESCRIPTION OF EXAMPLE EMBODIMENTS

Figure 1:
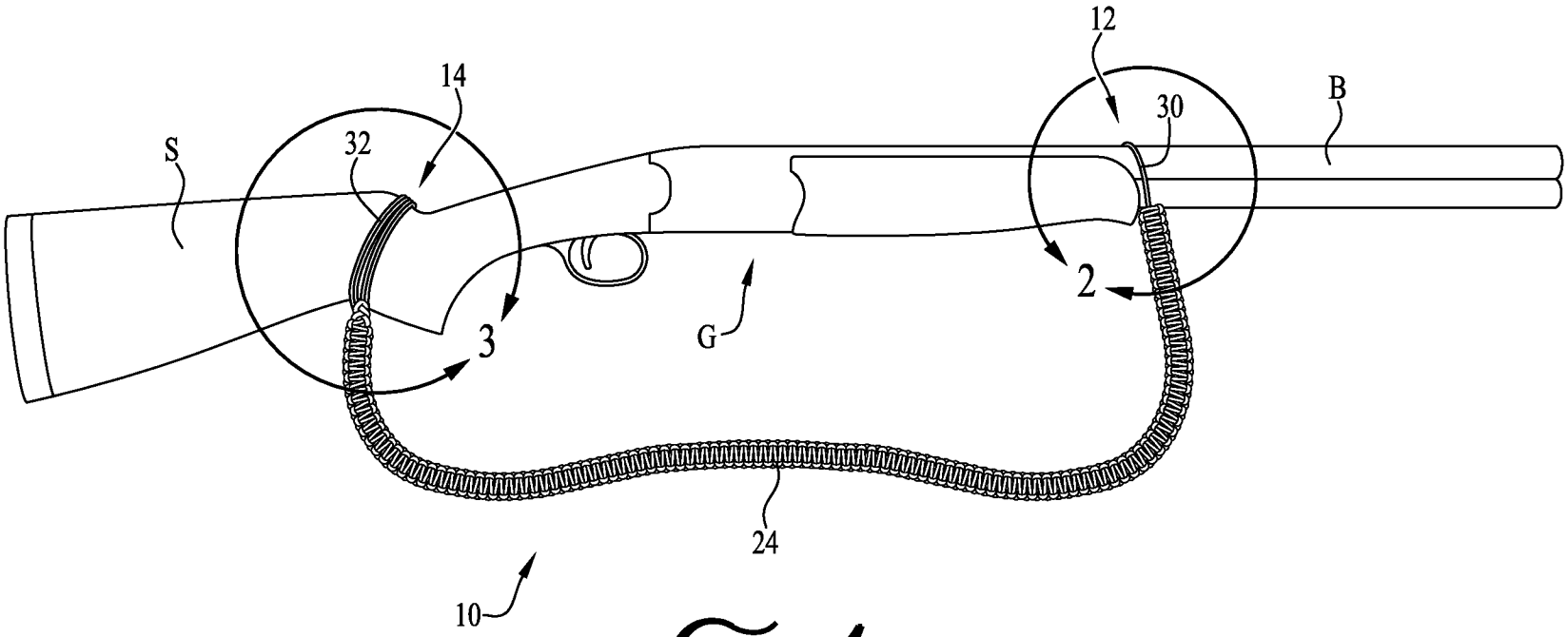
FIG. 1 is a side perspective view of a sling having tensionable ends according to an example embodiment of the present invention, and showing the sling removably mounted to a firearm according to an example use of the present invention.
Figure 3:
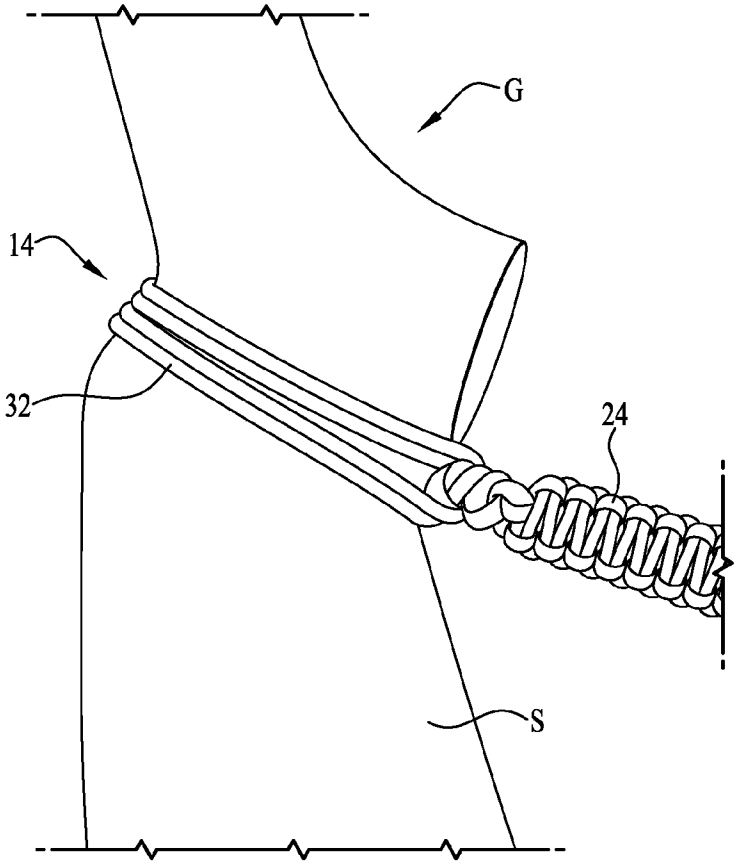
FIG. 3 is a close-up view of the sling and firearm of FIG. 1, showing a portion of the sling removably mounted to the stock of the firearm.
Figure 2:
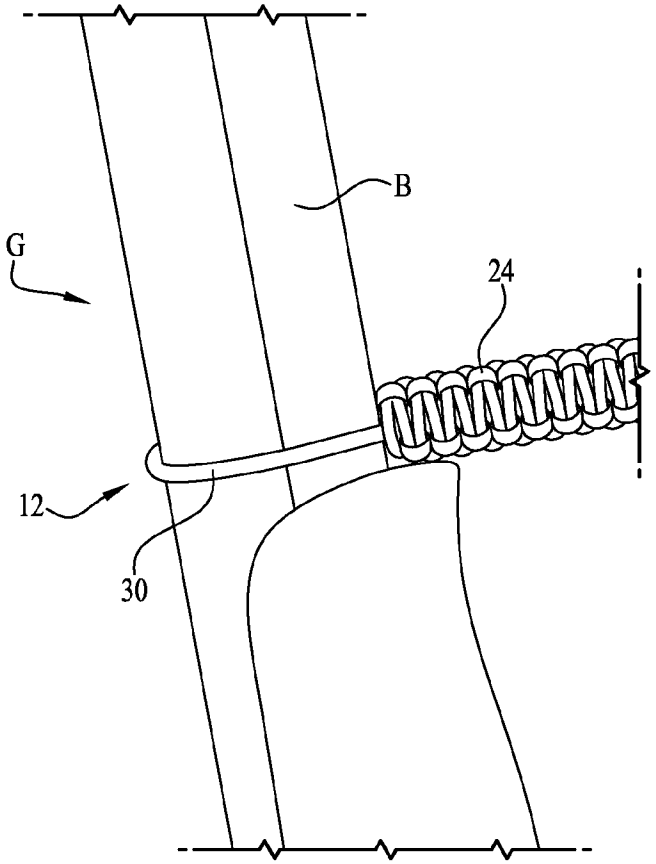
FIG. 2 is a close-up view of the sling and firearm of FIG. 1, showing a portion of the sling removably attached to the barrel of the firearm.
Figure 4:
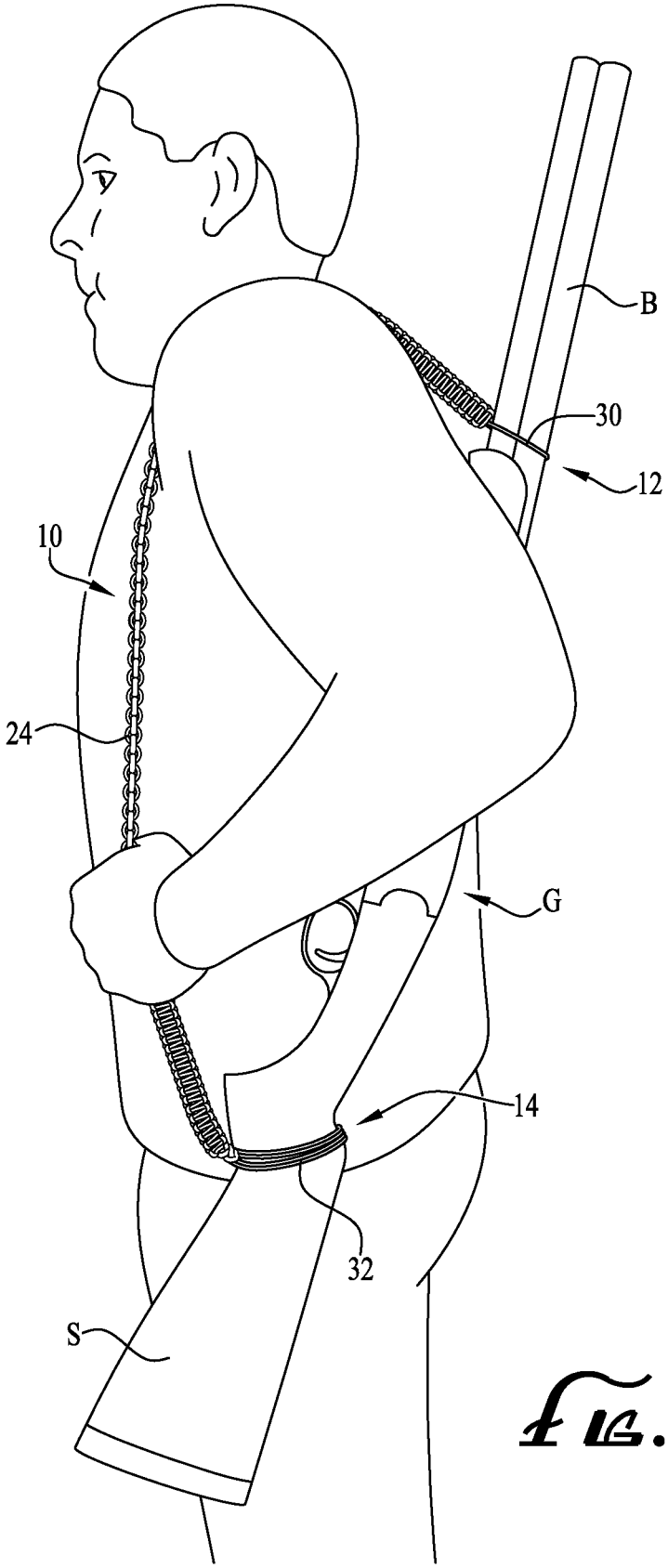
FIG. 4 is a side view of a user holding the sling and firearm of FIG. 1.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Generally described, the sling or strap 10 of the present invention preferably provides for removably engaging objects, for example, for the purposes of strapping one or more objects together, providing a carrying strap, sling or handle for one or more objects, acting as a tether, an animal leash and/or collar, or for other uses as desired. As will be described below, the sling 10 is preferably formed from a flexible rope or cord, such as a woven or braided nylon or polyester paracord or 550 cord, and comprises a first end and a second end generally opposite thereto. Each end preferably comprises an adjustable or tensionable ring or loop, which can be sized as desired to become tensioned or cinched around a desired object, for example, around the barrel of a firearm and around a stock portion of the firearm, thereby forming a firearm sling for carrying the firearm. Optionally, the tensionable loop can be looped around a portion of the woven material (forming a larger loop) for removably coupling to the stock portion of the firearm, or may be used for looping around larger objects. According to other example forms, the loop of each end can be removably coupled to an object such that the sling 10 acts to tether the objects together. Optionally, one or more or the loops may be provided with a clip, clasp, carabiner or other fastener for removably coupling to one or more objects, or for removably coupling a portion of the sling, as will be described below. Furthermore, one or more straps may be removably fastened to other objects to provide one or more carrying handles, straps, etc. as desired.

With reference now to the drawing figures, wherein like reference numbers represent corresponding parts throughout the several views, FIG. 1-4 show a sling 10 removably mounted to a firearm G according to example embodiments of the present invention. As depicted, the sling 10 is preferably removably mounted to the firearm G for carrying or holding the same. According to one example form, the sling can rest on a user's shoulder, for example, wherein the barrel B of the firearm G is generally facing in an upwards direction (see FIG. 4). Preferably, the sling 10 is configured to removably engage various types of firearms G including but not limited to shotguns (see FIGS. 1-4), assault rifles, long rifles, or other firearms, handguns, etc. as desired. Thus, preferably, the sling 10 is generally universal in that it can removably couple to a wide variety of firearms. Typically, as shown in FIG. 1, the sling 10 generally comprises an elongate and flexible member extending from a first end 12 to a second end 14, which are generally positioned on opposite ends of a central woven portion 24. Preferably, a first loop 30 is provided at the first end 12 and a second loop 32 is provided at the second end 14. As shown, the first loop 30 of the first end 12 is fitted and tensioned around the barrel B of the firearm G and the second loop 32 of the second end 14 is fitted around a portion of itself and tensioned thereto (e.g., forming a larger loop capable of being tensioned around a portion of the stock S of the firearm G). Thus, with the first loop 30 tensioned around the barrel B and the second loop 32 looped around itself (forming a larger loop for fitting and tensioning around the stock S of the firearm G), the sling 10 acts as a carrying handle or shoulder strap to assist in holding or carrying the firearm G (see FIG. 4). Optionally, as may be desired with some firearms, the second loop 32 may be fitted around a portion of the central woven portion, for example when the loop 32 itself is generally too small to fit around the stock of the firearm or other object.

Preferably, the sling 10 is generally universal in that it can removably engage various firearms of different sizes, shapes, configurations, etc. According to some example forms, the sling 10 is capable of removably engaging an over-and-under shotgun, for example, a firearm G which generally has no hardware or other fasteners for receiving a sling or strap, or connectors or couplings thereof, and to which a user may not wish to attach mounting hardware that might mar the finish of the firearm F. Optionally, a shoulder pad or other padded accessory may be provided with the sling 10 for providing additional comfort for carrying the sling. For example, the shoulder pad can be provided with an opening extending therethrough wherein the sling 10 can extend therethrough such that the pad is capable of moving along the length of the sling 10. Optionally, a portion of one or both of the loops 30, 32, or one or more portions of the central woven portion 24, may comprise a coating or other soft and/or frictional engaging surface such that any movement therebetween potentially causing wear or rubbing (e.g., engagement between the loops and/or central woven portion with the barrel B and/or stock S of the firearm G) is at least substantially eliminated. In one example form, a soft rubberized material is provided to coat at least a portion of the loops 30, 32 and the central woven portion 24. According to some example forms, the coating on the central woven portion 24 is provided along a portion of the larger loop that is engaged with the stock S, and the coating is applied to at least a portion of the first loop 30, for example, to prevent the sling 10 from rubbing against the firearm G, and wherein there is no wear or damage to the firearm G when portions of the sling slightly rub against the firearm 10 during the use thereof. Optionally, a sheath-like tube of fabric surrounds at least a portion of the central woven portion and/or at least a portion of one of the loops to provide a soft anti-wear engagement with the firearm. In some example forms, the sheath is formed from sheep skin or other natural or synthetic fibers.

The present invention also relates to a method of manufacturing the sling 10. In example forms, the sling 10 is formed from several feet, for example, about 50 feet of a cord or string-like material. In some forms, 550 paracord (e.g., generally type-III parachute cord) is provided, which may be in any color (or a combination of colors) as desired. Optionally, other ropes, cords, cables, or string, formed from any desired material including nylon, other polymers, carbon fiber, Kevlar, other natural or synthetic materials, or other materials may be used as desired. Alternatively, other paracord types including I, IA, II, IIA, III, and IV may be used as desired. Moreover, the cord may include one or more burnable fiber elements (e.g., fire cord) such that an additional function of providing a sustained flame in threatening or emergency situations is possible. As described herein, the weave used is generally a cobra weave. Optionally, other weaves including king cobra, zig-zag, trilobite, helix, jagged, sawtooth, lizard, corset, ladder, braid, double braid, square braid, fishtail, checker, or other braids may be used as desired. Optionally, according to other example embodiments, a combination of weaves may be provided.

Figure 5:
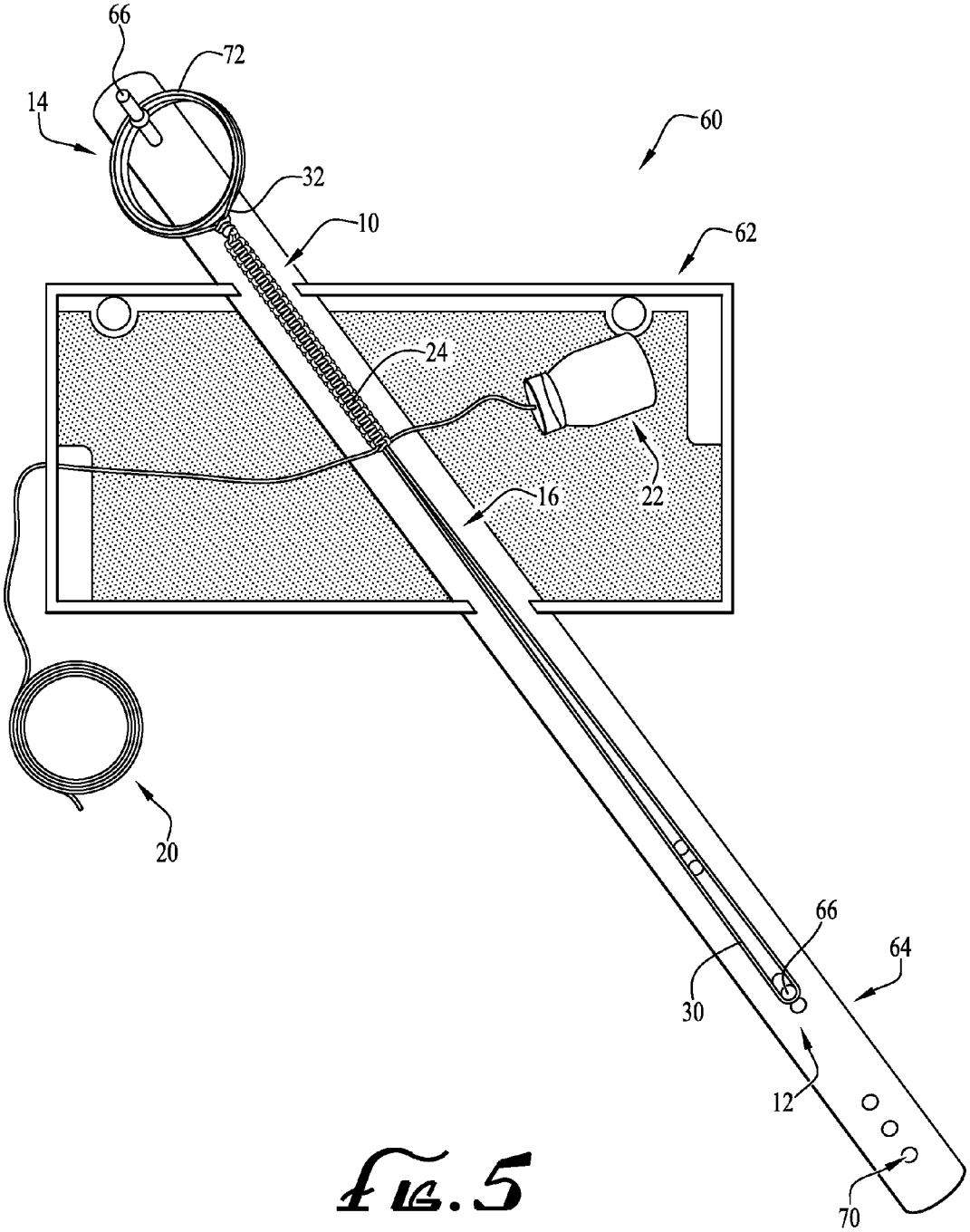
FIG. 5 shows an apparatus and method for manufacturing the sling of FIG. 1 according to another example embodiment of the present invention.

FIG. 5 shows an example embodiment of an apparatus or tying jig 60 for temporarily fixating the cord so that the sling 10 can be formed by forming the plurality of weaves along the length thereof. According to example forms, the tying jig 60 generally comprises a tray 62 and a movable arm 64 that is configured to slidably engage the tray 62. In example forms, the arm 64 comprises at least two pins 66 that are configured for removable engagement with a plurality of openings 70 formed within the arm 64. For example, depending on the desired length of the completed sling 10, the pins 66 can be repositioned to the appropriate openings 70 such that the completed sling 10 is the preferred length. Furthermore, as will be discussed below, a loop ring 72 is preferably provided for receiving the second loop 32 when the sling 10 is being woven while reomovably attached to the pins 66 of the arm 64. According to example forms, the loop ring 72 generally comprises a circumference of between about 8-24 inches, more preferably between about 10-20 inches, for example, about 16 inches.

In an example method of fabrication, a user begins the process of making the sling by providing about 50 feet of cord, for example, 550 paracord or other cord as desired. The cord is then divided into two 25 feet sections such that the middle point is looped around one of the pins 66. According to one example form, the middle point that is looped around the pin 66 defines the eventual first end 12 of the completed sling. The free ends of the 25 feet cord sections are then pulled substantially tight and brought around the loop ring 72 (that is engaged with the other pin 66) and a slip knot is formed, for example, so that a main line 16 (e.g., two cords) is formed between the ends 12, 14. Thus, according to example forms, the second loop 32 comprises two pieces of cord whereas the first loop 30 comprises a single cord. After tying the slip knot, the user separates the free ends into a first cord bunch 20 and a second cord bunch 22. To benefit the weaving process, at least one of the cord bunches 20, 22 may be inserted within a bottle or container such that the free portion thereof is not prone to get tangled during the weaving process. According to one form, the container for temporarily containing the second cord bunch 22 is in the form of a medicine bottle with a hole drilled in its cap such that the cord can move therethrough. Optionally, other types of containers may be used as desired.

The user then begins the weaving process by forming a cobra weave around the main line 16 along the length of the main line 16, for example, to define the central woven portion 24. In example forms, the central woven portion 24 is provided by a plurality of weave, knot or stitch portions or segments that are formed along the main line 16 and stretching between the pins 66. In example forms, between about 2-20 pounds of force is applied to the ends of the cord after weaving each of the woven portions. Preferably, tensioning each weave with generally between about 10-16 pounds of force being applied to the ends ensures that the weaves are frictionally engaged with the main line 16, and thus capable of controlling the size of the loops at the first and second ends 30, 32. Thus, according to example embodiments, the central woven portion 24 comprises an array of inter-linked and tensioned cobra weaves that are generally compressed against one another along the length of the main line 16 while being generally frictionally engaged with the main line 16. Preferably, adjusting the size of the loops (as described in FIGS. 7-10) is controllable due to the weaves being frictionally engaged with and slidable along the main line 16. Thus, once at least one of the loops of the first or second ends is engaged with a desired object, the weaves are pushed towards the loop such that any slack in the loop is removed and the loop is tensioned around the object, and wherein at least a portion of the plurality of weaves are generally bunched or compressed against one another near the loop.

The user continues to form a plurality of cobra weaves around the main line 16 until a majority of the main line 16 is covered by the weaves. Preferably, at least a portion of the main line 16 near the first end 12 does not comprise the weave as the first loop 30 is provided. In some example forms, after a plurality of weaves are provided along the main line 16, the user can grip the central woven portion 24 and slide the entirety thereof towards the second end 14 (e.g., compressing the same), for example, to ensure that a sufficient amount of weaves are provided along the length of the main line 16. According to example forms, the central woven portion 24 is generally compressed between about 3-5 times during the tying and weaving process. Preferably, compressing the central woven portion 24 between about 3-5 times during the process of trying ensures that enough weaves will be present on the main line 16 to provide for frictionally locking the main line relative to the weaves, for example, such that the loops can be tensioned and generally remain tensioned as desired.

During the weaving process, the user may move the arm as desired to provide easier access to the portion of the sling that is being woven. Once the weave is within about two inches of the pin 66 (e.g., near the first end 12), the excess cord from the first and second bunches 20, 22 can be trimmed or cut at about 0.25 inches away from the central woven portion 24. Heat is then applied to the cut ends of the cords 20, 22, thereby causing the ends to melt such that a bulged flange can be provided, for example, to prevent the ends from coming unwoven or passing back through the weave. Optionally, a material or coating may be applied over the melted ends to further prevent the sling from becoming unwoven. The loop ring 72 can then be removed from the second loop 32 at the second end 14 and the first loop 30 can be removed from the pin 66 at the first end 12. According to one example form, the completed sling 10 comprises a series of inter-linked weave segments defining a continuous woven pattern forming at least a portion of the length of the sling (e.g., the central woven portion 24), and wherein the main or central line 16 defines the loops 30, 32 and extends from the first end 12 to the second end 14 and supports and receives tension thereon by the series of inter-linked weave segments.

Optionally, the sling 10 can be formed from two generally separate pieces of cord, for example, to form a bi-color sling. For example, according to some example forms, the user may want to provide an accented color along the length of the central woven portion 24. As the case may be, after the slip knot is formed and the user separates the free ends into a first cord bunch 20 and a second cord bunch 22, one of the cord bunches is cut generally at about 4 inches away from the slip knot. Then, a separate and generally non-similar, colored cord is tied into the 4 inch cord bunch. According to example forms, the colored cord is tied to the 4 inch cord bunch by using a fishermans knot, and the excess cord extending from the ends is trimmed and generally melted or heated to cause substantial permanent engagement therebetween. As described above, the user then begins to form a plurality of cobra weaves along the length of the main line 16.

Figure 6:
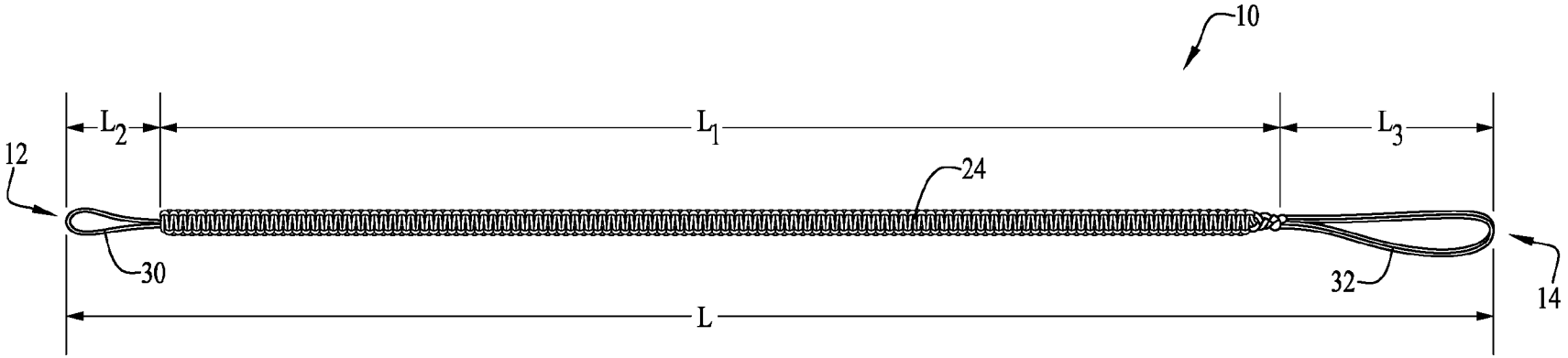
FIG. 6 is a front view of the sling of FIG. 1, showing the generally elongate extension thereof and the tensionable ends.
Figure 7:
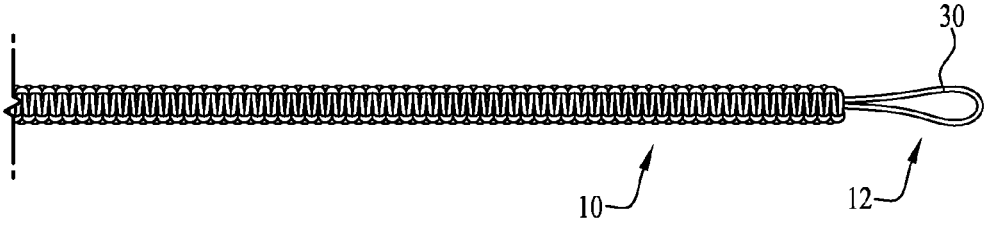
FIGS. 7-10 show a method of tensioning the ends of the sling of FIG. 1 according to another example embodiment of the present invention.

FIG. 6 shows the completed sling 10. According to example forms, the sling 10 comprises a length L that extends from the first end 12 to the second end 14. The central woven portion 24 that is defined between the first and second loops 30, 32 comprises a length L1, the first loop 30 comprises a length L2, and the second loop 32 comprises a length L3. According to example forms, the length L is generally between about 30-50 inches, for example between about 35-45 inches, and in a particular example about 40.5 inches. The length L1 of the central woven portion is generally between about 20-40 inches, for example between about 25-35 inches, and in a particular example about 29.5 inches. The length L2 of the first loop 30 is generally between about 2-8 inches, for example about 2.5-6 inches, and in a particular example about 3 inches. The length L3 of the second loop 32 is generally between about 2-16 inches, for example about 6-12 inches, and in a particular example about 8 inches. Optionally, the lengths L, L1, L2 and L3 may be sized as desired.

Figure 8:
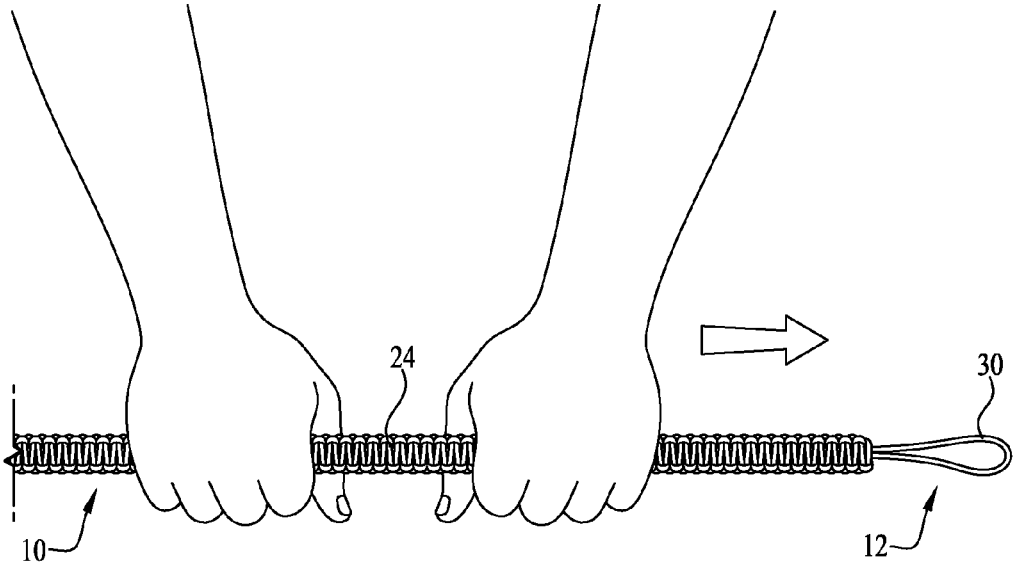
Figure 9:
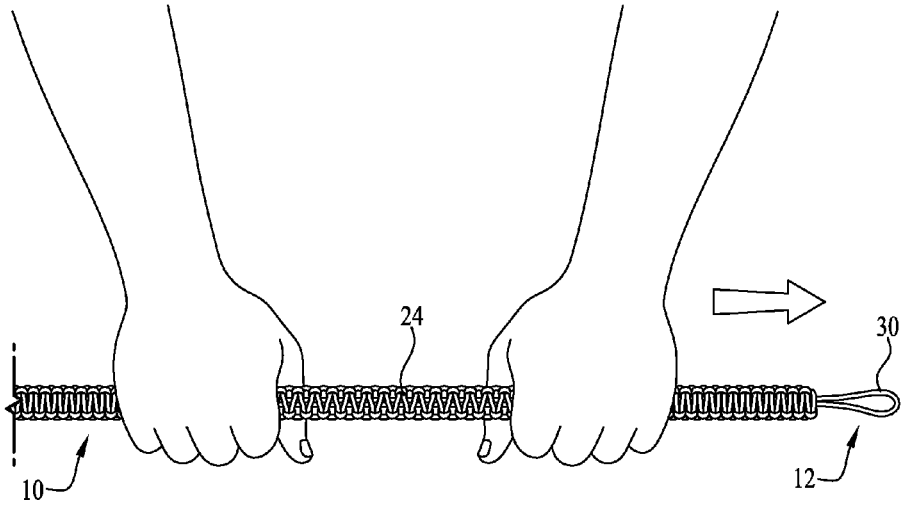
Figure 10:
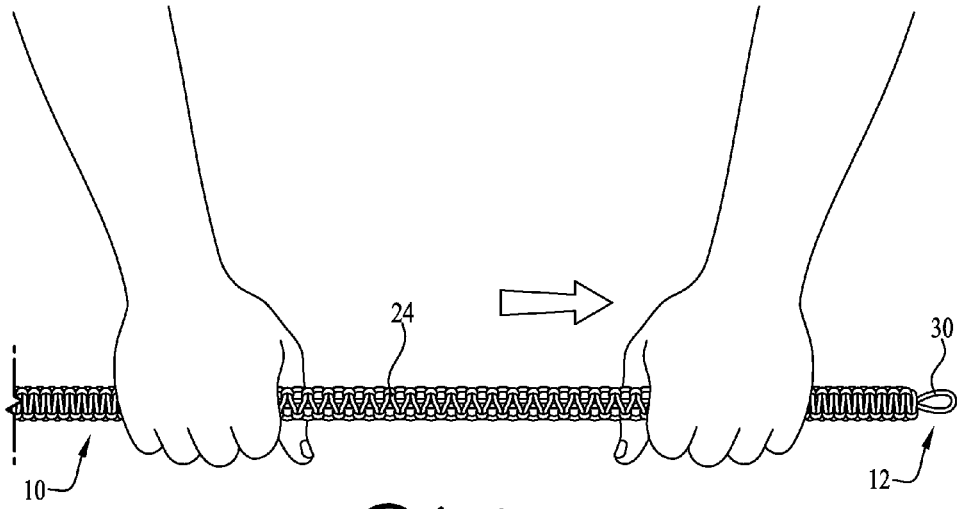

FIGS. 7-10 show a method of tensioning or adjusting the size of the loops 30, 32 of the first and second ends 12, 14 of the sling 10 according to an example embodiment of the present invention. For example, a user is capable of reducing the size of the loops 30, 32 by grasping and pushing or pulling the portions of the central woven portion 24 towards the loops 30, 32. For example, as depicted in FIG. 8, a user grasps the central woven portion 24 generally near the midpoint thereof with their right hand and the user's left hand grasps the central woven portion 24 at a point generally between the midpoint of the central woven portion 24 and the first loop 30. With the user's right hand generally remaining stationary, the user's left hand (while grasping the central woven portion 24) is moved towards the first loop 30, thereby causing the plurality of weaves being grasped by the left hand to move along the main line 16 towards the first loop 30, and thus, incrementally reducing the size of the first loop 30 (see FIG. 9). The user then repositions their right hand slightly closer to the first loop 30 and similarly repositions their left hand slightly closer to the first loop 30. Again, with the user grasping the central woven portion 24 with their right and left hands, the user generally moves their left hand (while grasping the central woven portion 24) relative to their right hand closer to the first loop 30, further reducing the size of the first loop 30 (see FIG. 10). In example forms, a ring, clip, pin or other object (e.g., such as the object to be removably attached to) is at least partially positioned within a portion of the loop 30 such that the loop 30 cannot be fully retracted into the weaves (e.g., the loop is entirely within the weaves). In the same manner, the size of the second loop 32 can be reduced in a substantially similar manner as described above. Furthermore, to increase the size of either of the loops 30, 32, at least a portion of the loop is held and at least a portion of the plurality of weaves are pushed away from the loop (e.g., in an opposite direction), thereby causing the loop to become larger. Thus, according to example embodiments of the present invention, manipulation of the central woven portion (e.g., the interlinked woven segments) permits adjustment of the size of the first and second loops, for example, such that the loops can be placed around objects or portions of the sling to become generally securely tensioned thereabout. Preferably, when the weaves are compressed against each other, the main line is generally incapable of moving relative to the weaves, and thus, the size of the loops 30, 32 generally remain the same size. However, when the weaves are at least partially separated, the main line 16 is at least partially able to move therethrough (e.g., by applying a force to the main line), for example, such that the size of the loops 30, 32 can be adjusted.

Figure 11:
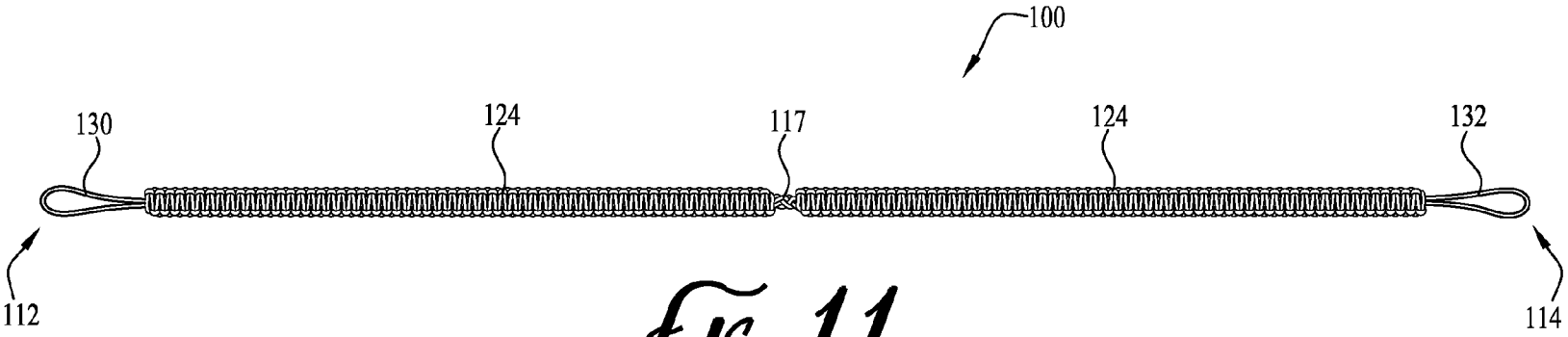
FIG. 11 shows a front view of a sling having tensionable ends according to another example embodiment of the present invention.

FIG. 11 shows a sling 100 according to another example embodiment of the present invention. As depicted, the sling 100 is generally similar to the sling 10 as described above. According to example forms, the main line 116 of the sling 100 comprises at least one knot 117 generally formed at a midpoint of the sling 100, which generally separates the central woven portion 124 into two sections. As such, each section of the central woven portion 124 is capable of providing tension to the loop that is generally adjacent its central woven portion section. According to some example forms, the at least one knot 117 is in the form of a double fishermans knot.

Figure 12:
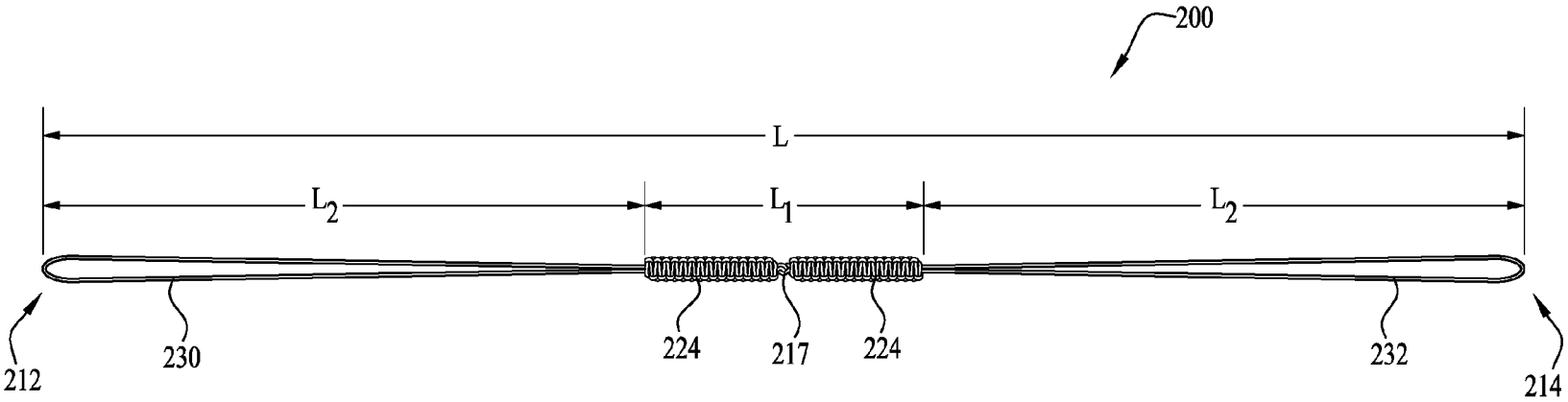
FIG. 12 shows a front view of a sling having tensionable ends according to another example embodiment of the present invention.
Figure 13:
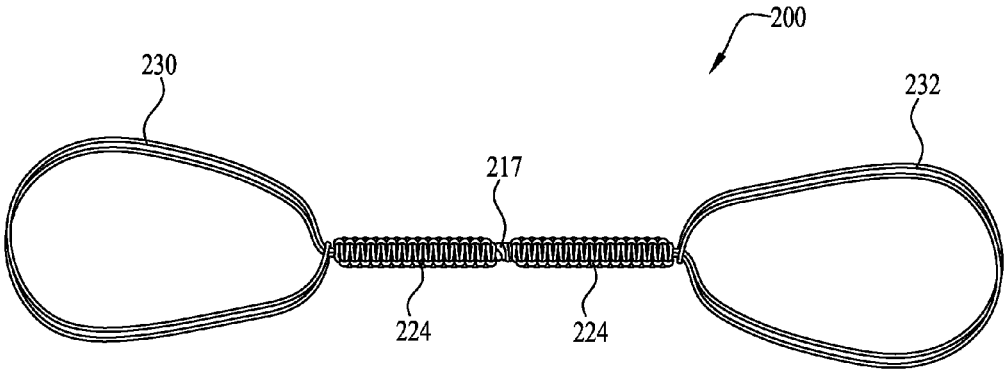
FIG. 13 shows the sling of FIG. 12, wherein the tensionable ends thereof are looped, respectively, to form tensionable loops.
Figure 14:
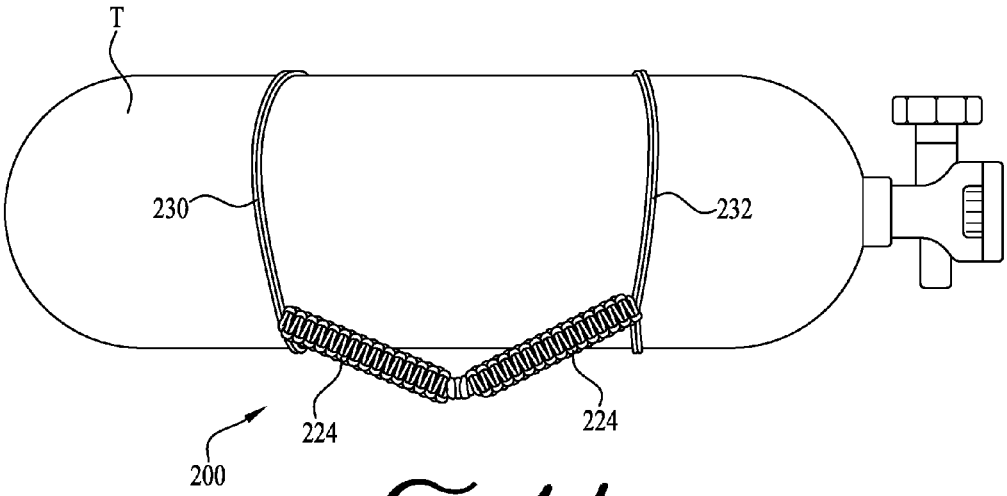
FIG. 14 shows the sling of FIG. 13 removably mounted to an air tank according to another example embodiment of the present invention.

FIGS. 12-14 show a handle or sling 200 according to another example embodiment of the present invention. As depicted in FIG. 12, the sling 200 is generally configured similarly to the sling 100, for example, wherein at least one knot 217 is formed along the main line 216, thereby separating the central woven portion 224 into two sections. Generally, a first loop 230 is provided between the first end 212 and one of the central woven portion sections 224, and a second loop 232 is provided between the second end 214 and the other of the central woven portion sections 224. Preferably, the loops 230, 232 are substantially large as compared to the loops as described above. In example forms, the sling 200 comprises a length L that extends from the first end 212 to the second end 214, a combination of both of the central woven portion sections 227 comprise a length L1, and each of the loops 230, 232 comprise a length L2. According to one example form, the length L is generally between about 30-70 inches, for example between about 40-60 inches, and in a particular example about 52 inches. The length L1 is generally between about 8-20 inches, for example between about 8-15 inches, and in a particular example about 10 inches. The length L2 of the loops 30, 32 are generally between about 10-35 inches, for example between about 15-25 inches, and in a particular example about 21 inches. Optionally, other lengths may be chosen as desired.

According to one example form, the sling 200 is preferably provided for removable attachment to a high pressure air tank T, for example, for scuba gear or other gear where a tank of oxygen is desired (see FIG. 14). For example, most fire departments generally have at least several air tanks for use in situations where a responder may need to wear the tank during a rescue mission within a burning building. In either case, the sling 200 preferably provides benefits to the user in carrying the air tank T, or carrying multiple air tanks at once. As depicted in FIG. 13, the loops 230, 232 of the sling 200 are looped around each other, respectively, to form loops to be received by the air tank T. As shown in FIG. 14, the loops are fitted around the tank T and then the central woven portion 224 is grasped and tensioned to cause the loops to be substantially snug and tensioned against the tank T. In use, a user can easily carry one or more tanks at once by grasping the central woven portion sections 224, which generally acts as a handle.

According to additional example embodiments of the present invention, the slings 10, 100, 200 may be provided for removably attaching to other objects, tools, etc. for providing a carrying handle, sling, strap, tether, etc. as desired. According to example forms, the sling 10 can include a clip or carabiner C attached at each end, for example, wherein one clip C is coupled to the first loop and another clip C is coupled to the second loop. Optionally, the loops can be tensioned around the clips such that there is generally no slack left in the loops. The clips can be removably attached to objects as desired, for example, to end portions of a hunting bow, ends of a duffle bag, etc. In alternate embodiments, the sling 10 provides for assisting in carrying or holding the hunting bow, for example, wherein a user can place the strap on their shoulder. Optionally, other bows, crossbows, archery systems, quivers, cases, etc. may utilize the sling 10, as described herein.

In further example forms, a sling 10 can be used to carry or drag game, such as for example by tensioning the loops of the ends of the sling around the base of a game animal's antlers or legs, for example, to provide a tether therebetween and to assist in carrying or dragging the game. Optionally, the loops of the ends of the sling 10 are tensioned around the base of two separate antlers, for example, to assist a hunter in calling or attracting wild game. According to another example application, the sling 10 can be removably attached to various pieces of fire equipment/gear including but not limited to a fireman's jacket, boots, and helmet, an air tank as described above, a radio and microphone unit, etc. Optionally, the sling may be provided for removably attaching to an axe or fire rake.

According to another example embodiment, the sling may be removably attached to a life jacket at one end and attached to a paddle at another end. Preferably, while in a boat, raft, kayak, or canoe, the user wearing the life jacket does not have to worry about losing the paddle if it were to be dropped in water or otherwise displaced from the life jacket, for example, since the paddle is tethered to the life jacket, which is worn by the user. Optionally, the sling is configured to removably attach to a pair of keys, for example, to act as a lanyard. In one example form, the sling 10 comprises a generally large loop (formed from the central woven portion 16) such that the sling 10 can be grasped by one or more hands or placed around the neck of an animal, for example, a dog, cat, or other animal. In one example form, the loops are preferably large enough for tensioning around at least several waterfowl to act as a holding strap or duck tote, for example, wherein the loops are tensioned around the necks of the waterfowl after hunting. Optionally, the loops can be sized differently and the length of the sling can be smaller, for example, to removably couple to a flashlight or Maglite® to form a carrying handle.

According to another example form, the sling may be configured to act as a carrying strap or sling for a collapsible chair. According to one form, the first loop receives a clip and removably couples to a portion of the collapsible chair and the second loop is configured to grasp a portion of the central woven portion (forming a larger loop), which is removably coupled to another portion of the collapsible chair. In some example forms, the second loop generally couples to a collapsed leg portion of the collapsible chair. Optionally, the sling may be incorporated with, or removably or permanently attached to chairs, other collapsible chairs, outdoor chairs, camping chairs, hiking chairs, other outdoor furniture, hammocks, etc., for example, to act as a strap, carrying handle, sling, or other portions thereof. The sling may removably attach to portions of the chairs, etc. as desired, for example, wherein at least a portion of the chair (or component attached thereto) may be formed for cooperative removable engagement with one or more of the tensionable loops. In some example forms, the component attached thereto is generally in the shape of a dock cleat, which comprises a central base or stem and two oppositely-extending arms. As such, the loop may be removably attached to the component by extending over the arms and tensioning around the base. According to one example form, the component or dock cleat is generally permanently mounted to a dog collar, or permanently mounted to other objects, bags, etc. to provide for receiving the tensionable loop.

Optionally, according to another example application of the present invention, the sling may be adapted to act as a strap for eyewear retention. For example, according to some example forms, a thinner cord or string can be formed and sized to provide for tensioning the loops around temple portions of eyeglasses. Preferably, the strap provides for allowing removable engagement with the temple portions, for example, so that the strap can be installed and removed from the eyeglasses as desired.

According to additional example embodiments, the present invention relates to a method of removably attaching a sling to a firearm. In example embodiments, the sling comprises a generally elongate woven or braided strap comprising tensionable loops at first and second ends thereof. According to one example form, one of the tensionable loops is generally larger than the other tensionable loop. The method generally comprises placing the loops around the barrel of the firearm; moving the larger loop rearwardly on the firearm such that the larger loop is positioned around a portion of the stock of the firearm; maintaining the position of the smaller loop on a portion of the barrel of the firearm; tensioning the larger loop around the stock of the firearm; and tensioning the smaller loop around the barrel of the firearm. Accordingly, after tensioning both ends or loops of the sling (e.g., larger loop around the stock and first loop around the barrel), the sling is installed and ready for use in carrying the firearm.

While the invention has been described with reference to preferred and example embodiments, it will be understood by those skilled in the art that a variety of modifications, additions and deletions are within the scope of the invention, as defined by the following claims.

What is claimed is:

1. A sling comprising:

a main line;

a centrally positioned woven portion comprising a plurality of similarly patterned weaves, the weaves generally being woven at least partially around the main line, wherein at least a portion of the main line extends from each end of the woven portion to form loops, and wherein the weaves can be moved along the main line whereby the size of the loop at each end can be adjusted.

2. The sling of claim 1, wherein the plurality of weaves of the woven portion are at least partially frictionally engaged with the main line.

3. The sling of claim 1, wherein the plurality of weaves are generally in the form of a cobra weave.

4. The sling of claim 1, wherein each of the plurality of similarly patterned weaves are generally tightened at least partially around the main line with between about 10-14 lbs of pressure.

5. The sling of claim 1, wherein the loops provided at the ends of the strap are generally looped around portions of a firearm.

6. The sling of claim 5, wherein one of the loops is configured for looping and tensioning around a barrel portion of the firearm.

7. The sling of claim 5, wherein one of the loops is configured for looping around a stock portion of the firearm.

8. A tensionable and universal strap comprising:

a generally elongate and flexible member comprising a first end and a second end generally opposite thereto;

a central woven portion comprising a series of inter-linked weave segments defining a continuous woven pattern;

a first tensionable loop defined between the first end and a portion of the central woven portion; and a second tensionable loop defined between the second end and a portion of the central woven portion, wherein at least a portion of the inter-lined weave segments provide for frictional engagement with at least a portion of the first and second tensionable loops.

9. The tensionable and universal strap of claim 8, wherein the inter-linked weave segments are frictionally engaged with a main line extending through the entirety of the strap, and wherein the ends of the main line form the loops at the first and second ends.

10. The tensionable and universal strap of claim 9, wherein manipulation of the inter-linked weave segments provides for adjustment to the size of the first and second loops such that the loops can be place around objects and become substantially secured thereto.

11. The tensionable and universal strap of claim 10, wherein the loops are configured for removable engagement with a firearm.

12. The tensionable and universal strap of claim 11, wherein one of the first or second loops is configured for removable engagement with a barrel portion of the firearm and wherein the other of the first or second loops is configured for removable engagement with a stock portion of the firearm.

13. A sling comprising a generally centrally positioned woven portion extending from a first end to a second end and defining a length therebetween, the woven portion comprising a plurality of woven segments extending along the length, the first and second ends comprising tensionable loops extending therefrom, and wherein at least one of the plurality of woven segments is movable toward one of the first and second ends to cause adjustment to the size of at least one of the loops.

14. The sling of claim 13, wherein the length of the centrally positioned woven portion is generally between about 25 to about 35 inches.

15. The sling of claim 13, wherein the extension between the first and second ends defines a length of between about 35 to about 45 inches.

16. The sling of claim 13, wherein the tensionable loop of the first end comprises a length of between about 2 to about 8 inches.

17. The sling of claim 13, wherein the tensionable loop of the second end comprises a length of between about 2 to about 12 inches.

18. The sling of claim 13, wherein the centrally positioned woven portion comprises a series of inter-linked cobra weaves.

* * * * *